US006100627A

United States Patent [19]

Carretti et al.

[11] Patent Number: 6,100,627

[45] **Date of Patent: *Aug. 8, 2000**

[54] METHOD FOR CREATING AND MAINTAINING A REDUCING ATMOSPHERE IN A FIELD EMITTER DEVICE

[75] Inventors: Corrado Carretti, Milan; Bruno Ferrario, Rescaldina, both of Italy

[73] Assignee: SAES Getters S.p.A., Milan, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,465

[22] Filed: Jun. 5, 1997

Related U.S. Application Data

[63] Continuation of application No. 08/465,177, Jun. 5, 1995.

[30] Foreign Application Priority Data

Jul. 1, 1994 [IT] Italy ..... MI94A1380

[51] Int. Cl.[7] ..... H01J 1/02; H01J 1/62; H01J 63/04; H01J 17/22

[52] U.S. Cl. ..... 313/309; 313/495; 313/547; 313/549; 313/553; 313/559

[58] Field of Search ..... 313/389, 336, 313/346 R, 351, 495–97, 549, 553, 559, 561, 566; 445/50, 51

[56] References Cited

U.S. PATENT DOCUMENTS

| | | | |
|---|---|---|---|
| 3,460,974 | 8/1969 | King . | |
| 4,004,171 | 1/1977 | Heuvelmans et al. | 313/547 |
| 4,310,781 | 1/1982 | Steinhage et al. | 313/549 |
| 4,312,669 | 1/1982 | Boffito et al. . | |
| 4,457,891 | 7/1984 | Bernauer et al. . | |
| 4,567,032 | 1/1986 | Wallace et al. . | |
| 4,894,584 | 1/1990 | Steinmann et al. | 313/557 |
| 5,091,819 | 2/1992 | Christiansen et al. | 313/306 |
| 5,180,568 | 1/1993 | Boffito et al. | 423/248 |
| 5,191,980 | 3/1993 | Boffito et al. | 206/524 |
| 5,492,682 | 2/1996 | Succi et al. . | |
| 5,520,563 | 5/1996 | Wallace et al. | 445/41 |

FOREIGN PATENT DOCUMENTS

| | | | |
|---|---|---|---|
| 0443865A1 | 8/1991 | European Pat. Off. . | |
| 0572170A1 | 12/1993 | European Pat. Off. . | |
| 0 717 429 A1 | 6/1996 | European Pat. Off. . | |
| 2 005 912 | 4/1979 | United Kingdom | 29/94 |
| WO93/25843 | 12/1993 | WIPO . | |

OTHER PUBLICATIONS

M.S. Mousa, A Study of the Effect of Hydrogen Plasma on Microfabricated Field–Emitter Arrays, 1994 Vacuum pp. 235 to 239, vol. 45, No's. 2,3.

C.A. Spindt, "Field–Emitter Arrays for Vacuum Microelectronics" Oct. 10, 1991, vol. 38, No. 10. *IEEE Transactions on Electron Devices* pp. 2355–2363.

*Primary Examiner*—Nimeshkumar D. Patel
*Assistant Examiner*—Mack Haynes
*Attorney, Agent, or Firm*—Hickman, Stephens & Coleman, LLP

[57] ABSTRACT

A Field Emitter Device (FED) having a substantially reducing atmosphere is described. The atmosphere in a FED can be maintained substantially free of oxidizing gases and includes a partial pressure of hydrogen between about $1\times10^{-7}$ millibar (mbar) and $1\times10^{-3}$ mbar. In one embodiment, a non-evaporable getter material previously charged with hydrogen gas is placed inside the FED before the FED is sealed. The non-evaporable getter material can be charged by exposure to hydrogen gas at a pressure between about $1\times10^{-4}$ and about 2 bar. Subsequently, the components forming the FED are sealed, and the FED is evacuated and hermetically sealed to the outside atmosphere.

25 Claims, 4 Drawing Sheets

METHOD FOR CREATING AND MAINTAINING A REDUCING ATMOSPHERE IN A FIELD EMITTER DEVICE

This is a continuation of application Ser. No. 08/465,177 filed Jun. 5, 1995.

CLAIM OF FOREIGN PRIORITY PURSUANT TO 35 U.S.C. § 119

This application claims priority under 35 U.S.C. § 119 from Italian Patent Application Number MI 94 A 001380, filed Jul. 1, 1994, which is incorporated herein by reference.

BACKGROUND OF THE INVENTION

1. The Field of the Invention

The present invention relates to methods and devices for achieving and maintaining controlled atmospheres, and the devices in which such atmospheres are maintained. In particular, the present invention is related to producing and maintaining a controlled reducing atmosphere in a field emitter device.

2. The Background Art

Field emitter devices (FEDs) are under study for a variety of uses, including the production of flat panel displays (FPDs). These displays are presently under development to provide, for example, flat television screens.

A FED is generally produced by sealing two parallel, closely spaced, planar glass members along their perimeters. Typically, the sealing is performed by melting a glass paste having a low melting point along one or both of the perimeters of the two glass members and bringing the members together to sealably join them along their perimeters, a method known commonly as "frit sealing". The resulting structure consists of two parallel glass surfaces separated by an interior space a few hundreds of microns ($\mu$m) in width. The interior space of the FED typically is kept under vacuum.

On the inner surface of one glass member is positioned a plurality of pointed microcathodes (microtips) made of a metallic material, e.g., molybdenum (Mo), which emit electrons. A plurality of grid electrodes are placed proximate to the cathodes on the same surface so as to generate a very high electric field. On the opposing glass surface are deposited phosphors. The electric field created by the arrangement of grid electrodes and microtips ejects electrons from the points of the microtips and accelerates the electrons toward the phosphors, exciting the phosphors into luminescent states. The luminescence intensity of the excited phosphors, and, therefore, the pixel brightness, is directly proportional to the current emitted by the associated microtips.

Until now it was considered necessary to keep the pressure of the interior space below about $1\times10^{-5}$ millibar (mbar) to achieve good luminescence intensity. To this end several workers have proposed the use of getter materials, such as $BaAl_4$, (see, e.g., European Patent Application Serial No. EP-A-443865), in addition to metals such as tantalum (Ta), titanium (Ti), niobium (Nb) or zirconium (Zr) as described in European Patent Application Serial No. EP-A-572170. Powdered Ti, Zr, thallium (Th) and their hydrides have also been combined with Zr-based alloys and employed in the shape of porous layers as described in Italian Patent Application Serial No. M194-A-000359. Each of the above-cited patent applications is incorporated herein by reference.

Recent studies, however, suggest that not all the gases present in the interior space have a detrimental effect on the performance of the FED. In particular, hydrogen may be present in the device at pressures higher than about $1\times10^{-5}$ mbar. Spindt et al. in IEEE Transactions on Electron Devices 38(10): 2355–2363, 1991, and Mousa in Vacuum 45(2–3) :235–239, 1994, have shown that hydrogen does not substantially affect the electronic emission, even for long periods, if the hydrogen is present at a pressures less than $1.5\times10^{-2}$ mbar. Both of the references cited above are incorporated herein by reference in their entirety and for all purposes. Furthermore, introducing hydrogen into an "aged" FED, i.e., a FED whose electronic emissivity has decreased over time, restores the emissivity to its initial value. Spindt has also shown that oxidizing gases, in particular air, have the expected negative effect on the current emission from the microtips. Mousa further points out that the presence of hydrogen at pressures higher than $2\times10^{-1}$ mbar in the interior space also has a negative effect on the electronic emissivity, probably due to the erosion of the microtips resulting from their bombardment by hydrogen ions at these relatively high pressures. Thus, these studies together suggest that a gaseous environment inside the FED should be one that is relatively free of oxidizing gases and contains a small partial pressure of a reducing gas, in particular hydrogen.

Although the beneficial effects of hydrogen are generally known, there is at present no industrially useful method for controlling the amounts of hydrogen and oxidizing gases within the interior space of a FED. The academic studies performed to date have followed laboratory procedures in which hydrogen is introduced into the FED through a suitable conduit ("tail") formed in the structure of the FED itself and attached to an external hydrogen source. Unfortunately, such laboratory procedures are not readily applicable to the industrial production of FEDs. In particular, the introduction of low partial pressures of hydrogen into the space through an external hydrogen source is difficult to control reproducibly. In addition, local heating caused by the "tip off" process, in which the tail is closed by heating, can cause significant hydrogen leakage from the interior space. Finally, laboratory methods do not provide a practical method for maintaining the reducing atmosphere in the FED over its lifecycle.

Thus, it would be advantageous to provide a method for creating and maintaining a reducing atmosphere inside the interior space of a FED. It would also be advantageous to provide a FED capable of maintaining a reducing atmosphere throughout its lifecycle. In particular, it would be desirous to provide an atmosphere in a FED substantially free of oxidizing gases and including a reducing gas, such as hydrogen.

SUMMARY OF THE INVENTION

The present invention provides a method for maintaining a reducing atmosphere in the interior space of a field emitter device (FED) and a FED having such an internal reducing atmosphere. The method of the present invention can be applied reliably on an industrial scale to provide mass-produced FEDs that include the advantages provided by a controlled, reducing internal atmosphere including greater performance and longer lifecycle.

In one aspect the present invention provides a method for maintaining a controlled reducing atmosphere within a field emitter device. The method of the invention includes arranging a getter material charged with hydrogen, on at least one of the interior surface of opposing first and second planar portions which comprise the FED. The surfaces of the FED are joined to define an interior space into which the charged getter material releases the hydrogen to maintain thereby a substantially reducing atmosphere within the interior space of the FED. The hydrogen gas released by the getter may be present in the interior space at a partial pressure of between about $1\times10^{-7}$ millibar (mbar) and about $1\times10^{-3}$ mbar according to a particular embodiment of the invention.

In another aspect, the present invention provides a method of constructing a FED having the above-described desirable feature of a controlled, reducing internal atmosphere. The method of construction includes the steps of arranging material charged with hydrogen on at least one of the interior surface of opposing first and second planar portions which comprise the FED. The first and second planar portions are sealably joined along their perimeters to form an interior space. The pressure within the interior space is then reduced.

In one embodiment, the first and second portions are joined using a frit sealing procedure employing a low melting glass paste. In another embodiment, the reduction of pressure in the interior space is achieved by first forming a tail which is in fluid communication with the interior space, evacuating at least partially the atmosphere in the interior space and sealing hermetically the tail to isolate substantially thereby the interior space from the external atmosphere. In still another embodiment, the reduction of pressure in the interior space is achieved by joining the first and second portions in vacuo.

In still another embodiment, the present invention provides a field emitter device which comprises first and second planar portions that are sealably joined along their perimeters. The opposing surfaces of the first and second planar portions define an interior space. A getter material charged with hydrogen is placed in fluid communication with the atmosphere of the interior space.

In one embodiment, the above-mentioned getter material is an alloy having the general formula $A_{1+x}(B_{1-y}C_y)_2$. A can be Zr or Ti. B and C are selected independently from the group consisting of V, Mn, Fe, Co, and Ni. The quantity x is between 0.0 and 0.3, inclusive, and the quantity y is between 0.0 and 1.0, inclusive. These materials are charged with hydrogen at a pressure of between about $1\times10^{-4}$ bar and about 2.0 bar prior to said step of arranging, according to one particular embodiment of the invention. More specific embodiments of the just-described alloys include those wherein x is 0.0 and y is 0.5. Still more specific alloys include ZrMnFe, ZrVFe and TiVMn.

In another embodiment, the getter material is a Zr—V—Fe alloy whose percent composition by weight, when brought into a ternary composition diagram, falls within a triangle whose vertices are the following points:

1. Zr 75%-V 20%-Fe 5%;
2. Zr 45%-V 20%-Fe 35%; and
3. Zr 45%-V 50%-Fe 5%.

A particular Zr—V—Fe alloy of this class of alloys that is useful in the present invention is one having the composition Zr 70%-V 24.6%-Fe 5.4% by weight.

These and other aspects and advantages of the present invention will become more apparent when the Description below is read in conjunction with the accompanying Drawings.

DESCRIPTION OF SPECIFIC EMBODIMENTS

Figure 1:
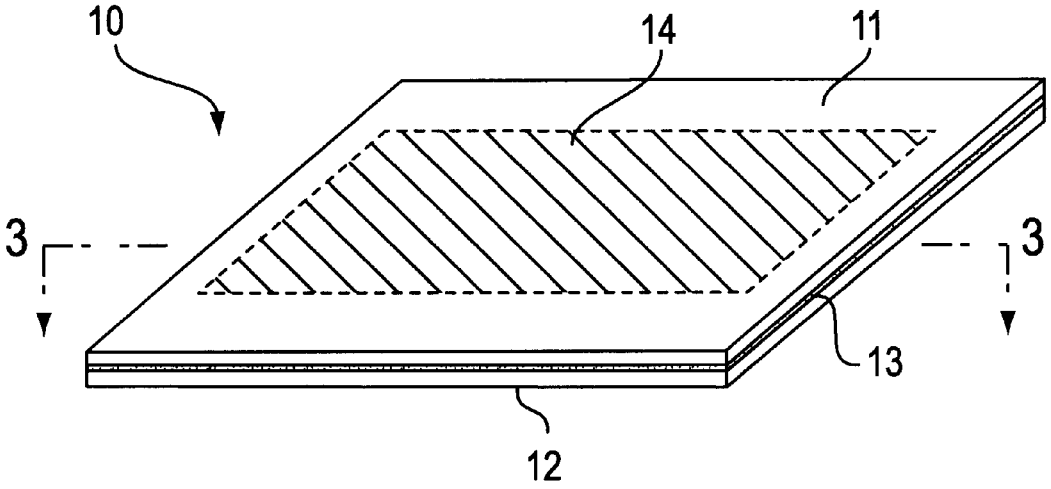
FIG. 1 shows a sealed Field Emitter Device (FED) in accordance with the present invention.
Figure 2:
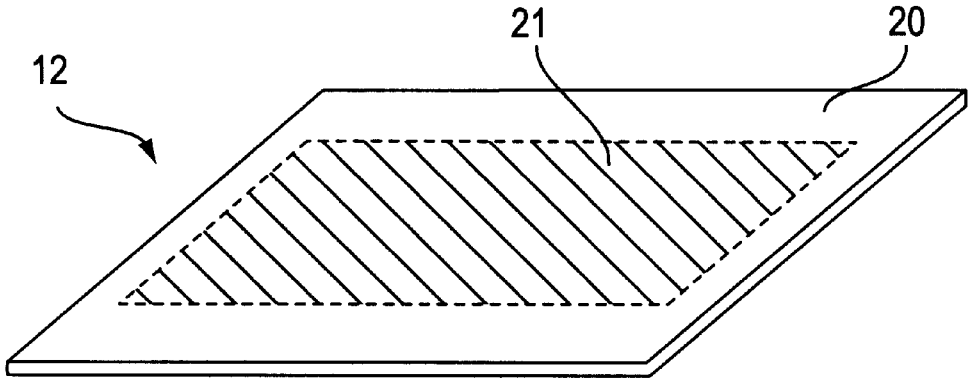
FIG. 2 shows the interior surface of the rear portion of a FED according to the present invention.

FIG. 1 illustrates an assembled Field Emitter Device (FED) 10, comprising a planar front portion 11 and a planar rear portion 12, both front and rear portion having external and internal surfaces. Portions 11 and 12 are closely spaced, aligned with each other and generally parallel. Although portions 11 and 12 are shown having rectangular shapes, it will be appreciated that the front and rear portions can have other shapes. For example, portions 11 and 12 can be circular or ovoid in shape, or include some other degree of curvature along their perimeters. The front and rear portions are sealed along their perimeters with a sealant 13. As described above, sealant 13 not only seals the front and rear portion of the FED but also defines an interior space in combination with the interior surfaces of the front and rear portions. This interior space is described in greater detail below. Also seen in FIG. 1 is a hatched region 14 indicating the approximate region of the interior surface of the front portion on which the phosphors are deposited. The interior surface 20 of rear portion 12 is illustrated in FIG. 2. Hatched region 21, disposed opposite to and corresponding with hatched region 14 of front portion 11 of FIG. 1, indicates the approximate region of the interior surface of the rear portion upon which the above-described microtips and grid electrodes are arranged.

The FED shown in FIG. 1, including the front and rear portions and their associated phosphors and microtips, is produced using standard techniques and materials known to those of skill in the art of solid state devices (see, e.g., EP-A-572,170 previously incorporated by reference). In one embodiment, the front and rear portions are glass and the sealant comprises a low melting glass paste. In another embodiment, the sealing is performed using a low melting glass paste at temperature of between about 400° C. and about 500° C. The evacuation of the interior space formed by the bonding of the sealant to the front and rear portions of the FED can be carried out either by combining the front and rear portions using the sealant in a vacuum chamber (the "vacuum chamber process"), or by providing a glass tail in the FED structure through which the sealed FED can be evacuated and which tail afterwards is closed hermetically through a tip-off (the "tail process") to isolate substantially the interior space from the atmosphere external to the FED. Both the vacuum chamber process and the tail process are known to those of skill in the art of solid state devices.

Figure 3:
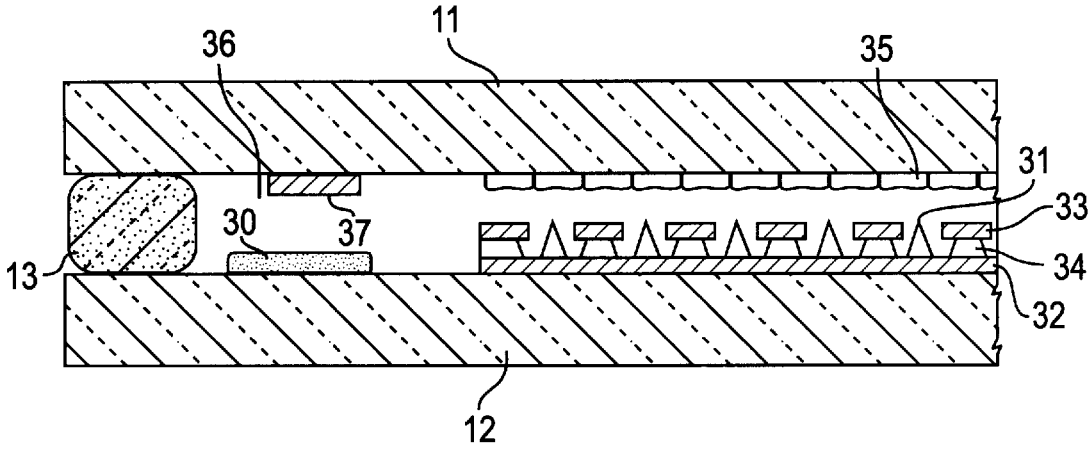
FIG. 3 shows a cross-section of the FED shown in FIG. 1 along the line 3—3 of that Figure.

FIG. 3 is a cross-section view (not to scale) along the line 3—3 of a FIG. 1, which shows a typical configuration of the elements inside the vacuum chamber of a FED constructed using the above-mentioned chamber process. In the embodiment illustrated, the elements of the FED include a deposit of getter material 30 on the interior surface of rear portion 12, microtips 31 arrayed on a silicon base 32 that also is layered on the interior surface of rear portion 12, and grid electrodes 33 that are arranged proximate to the microtips and separated from base 32 by a layer of a dielectric material 34. Phosphors 35 are layered on the interior surface of front portion 11. The gap between the interior surfaces of the front and rear portions defines an interior space 36 of the FED. In one embodiment, a resistive heater 37 is arranged opposite the getter material to heat the getter material as described below.

Getter material 30 will be described in detail below. Typically, the thickness of the front and rear portions 11 and 12 is on the order of millimeters, while interior space 36 is usually few hundreds of microns in width. Generally, the cathodic structure microtips and grid electrodes are a few microns high. Only a few microtips and grid electrodes are shown for the purpose of illustration. The actual density of the microtips arrayed on rear portion 12 can reach tens of thousands of microtips per square millimeter. The electric loops for feeding the device are not shown in the drawing. As noted above, the design, materials and construction of the FED shown in FIG. 3 will be well known to those of skill in the art of solid-state devices.

In the vacuum chamber process, front portion 11 and rear portion 12 of the FED are introduced into a vacuum chamber which is maintained under vacuum during the entire assembly process. The interior surfaces of the front and rear portions are juxtaposed and heated to the melting temperature of the sealant which performs the sealing. In one embodiment, the getter material is deposited in the form of strip, such as strip 30, along one or more regions of the surface on which the microtips are arrayed. However, it will be appreciated that the getter material can be applied as a strip on the interior surface of either or both the front and rear portions. Other arrangements will be apparent to those having skill in the art of solid state devices. The deposition of the getter material is described in Italian Patent Application Serial No. M194-A-00359, which is incorporated herein by reference.

Figure 4:
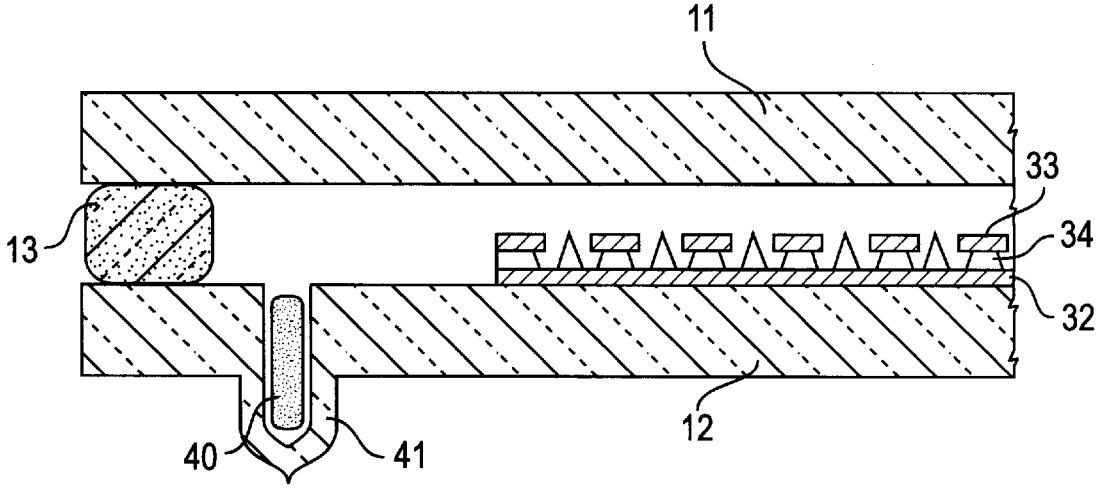
FIG. 4 shows a cross-section of a FED obtained through an alternate fabrication method along the same line as that shown in FIG. 3.

Alternatively, the FED may be produced using the "tail" process, in which the front and rear portions are frit sealed in a non-evacuated environment. The evacuation of the FED is carried out in a second step in which the atmosphere in the interior space is pumped out through a conduit (or "tail") suitably incorporated into either the front or the rear portion of the FED, generally the rear portion. FIG. 4, analogous to FIG. 3, shows a cross-section of a FED produced with the tail process. In this case the getter material 40 is deposited on the part of the tail 4) which remains after the "tip-off". However, it will be appreciated that the getter material can be applied as a strip on the interior surface of either or both the front and rear portions. Other arrangements will be apparent to those having skill in the art of solid state devices.

Regardless of the process used to form the FED, however, during the frit sealing the sealant, which is typically a low melting glass paste, releases a non-negligible quantity of gases and oxidizing vapors, in particular water, which can decrease considerably the electronic emissivity of the microtips. The present invention overcomes this deleterious effect by providing a getter material charged with hydrogen within the interior space of the FED. The charged getter material releases a portion of the hydrogen it was previously charged with into the atmosphere of the interior space of the FED, thereby producing a substantially reducing atmosphere which counteracts the deleterious effects of the oxidizing gases released into the interior space of the FED during the frit sealing process. In addition, a mechanical expulsion of the oxidizing gases from the interior space of the FED may be produced as a result of overpressure created by the release of hydrogen gas from the getter material.

In one embodiment, the charged getter material in the FED is present in a supported form. For example, the charged getter material can be rolled on as a metallic tape or as a powder pressed inside an open container. Charged getter materials being employed as a reservoir of hydrogen preferably have a relatively high equilibrium pressure of hydrogen at temperatures close to the room temperature—the working temperature of the FEDs—in order to provide a pressure of hydrogen between about $1\times10^{-7}$ millibar (mbar) and about $1\times10^{-3}$ mbar inside the FED after the FED is sealed. Such an atmosphere, or an atmosphere having an equivalent reducing effect, will be referred to herein as a "substantially reducing atmosphere". In one embodiment of the invention, the support may be heated periodically during the life of the FED using a heating element in thermal contact with the getter material in order to increase the emission of hydrogen if a decrease in time of the device efficiency is noticed. For example, the heating element may be a resistor placed on the face of the support opposite the face on which the getter material is fixed, such as shown at 37 in FIG. 3, or the electrical resistance of the support itself may be exploited to effect the heating of the getter material. This embodiment provides greater control over the hydrogen pressure inside the FED during the life of the device. The heating can also be effected by using ambient heat available in the interior space of the FED.

Getter materials employable in the present invention generally are those getter materials capable of being charged with (i.e., storing) and releasing a reducing gas such as hydrogen. Preferred chargeable getter materials are those capable of releasing hydrogen at or near room temperature, or the temperature of the interior space of the FED. In one embodiment, the chargeable getter materials include alloys having the general formula $A_{1+x}(B_{1-y}C_y)_2$, wherein 1) A is Zr or Ti;
2) B and C are selected independently from the group consisting of Cr, V, Mn, Fe, Co, and Ni;
3) x is between 0.0 and 0.3; and
4) y is between 0.0 and 1.0.

In addition, the above-described alloy can also contain small amounts of an additional transition metal.

Particular examples of alloys useful in the present invention include the following:

1) $ZrM_2$ alloys, where M is a transition metal selected from the group consisting of Cr, Mn, Fe, Co or Ni, and their mixtures, as described in U.S. Pat. No. 5,180,568 to Boffito, et al., entitled "Recovery of Tritium and Deuterium From Their Oxides and Intermetallic Compound Useful Therein", issued Jan. 19, 1995, and incorporated herein by reference;
2) the intermetallic compound ZrMnFe, manufactured and sold by SAES Getters S.p.A. (Milan, Italy) under the tradename St 909;
3) the Zr—V—Fe alloys described in U.S. Pat. No. 4,312,669 to Boffito, et al., entitled "Non-Evaporable Ternary Gettering Alloy and Method of Use For the Sorption of Water, Water Vapor and Other Gases", issued Jan. 26, 1982, and incorporated herein by reference, whose percent composition by weight, when brought into a ternary composition diagram, falls within a triangle whose vertices are the following points:
   Zr 75%-V 20%-Fe 5%;
   Zr 45%-V 20%-Fe 35%; and
   Zr 45%-V 50%-Fe 5%;

and in particular the alloy having the percent composition by weight Zr 70%-V 24.6%-Fe 5.4% manufactured and sold by SAES Getters S.p.A. (Milan, Italy) under the tradename St 707;

4) the intermetallic compound ZrVFe manufactured and sold by SAES Getters S.p.A. (Milan, Italy) under the tradename St 737;
5) Ti—Ni alloys having 50%–80% Ti by weight and, in particular, the alloy $Ti_2Ni$ which alloy is described in co-pending U.S. Pat. No. 5,492,682 entitled "Hydrogen Purification", filed on Apr. 21, 1994, and incorporated herein by reference; and
6) the Ti—V—Mn alloys described in U.S. Pat. No. 4,457,891, which patent is incorporated herein by reference.

The charging of the above-described getter materials with hydrogen can be performed by placing the getter material to be charged in a suitable chamber at room temperature and introducing hydrogen gas into the chamber at a pressure between about $1\times10^{-4}$ bar and about 2 bar for between about 1 minute and about 60 minutes. Example 1 below illustrates one method for charging getter materials with hydrogen.

The values of the hydrogen pressure to be employed depend on the particular getter material which is being charged. Exemplary pressure ranges for charging the above-mentioned materials with hydrogen include the following:

1) ZrMnFe: between about 0.5 bar and about 2 bar;
2) Zr 70%-V 24.6%-Fe 5.4% alloy: between about $1\times10^{-4}$ bar and about 0.1 bar;
3) ZrVFe: between about 0.01 bar and about 0.1 bar;
4) Ti—Ni alloys: between about 0.01 bar and about 0.1 bar; and
5) Ti—V—Mn alloys: between about $1\times10^{-4}$ bar and about 0.1 bar.

The particular hydrogen pressure applied in the alloy charging step also is influenced by the sealing operation used in making the FED. As mentioned earlier, during the sealing operation the getter material is indirectly heated and releases part of the hydrogen contained therein. The released quantity of hydrogen depends on the thermal cycle the FED is subject to, and, in particular, the length of time the FED remains at the highest temperature used in the sealing operation. The knowledge of the details of the sealing process and of the equilibrium pressure of hydrogen above the various alloys as a function of the temperature allows one of skill in the art using standard methods (e.g., Sievert's Law) to determine the quantity of hydrogen to be initially introduced into the getter material so that, after the sealing operation, the getter material can generate an equilibrium pressure in the range of the pressures desired in the FED.

EXAMPLES

The following Examples are offered solely for the purpose of illustrating the features of the present invention and are not to be considered as limiting the scope of the present invention in any way.

Example 1

This Example illustrates the charging of a getter alloy with hydrogen.

Figure 5:
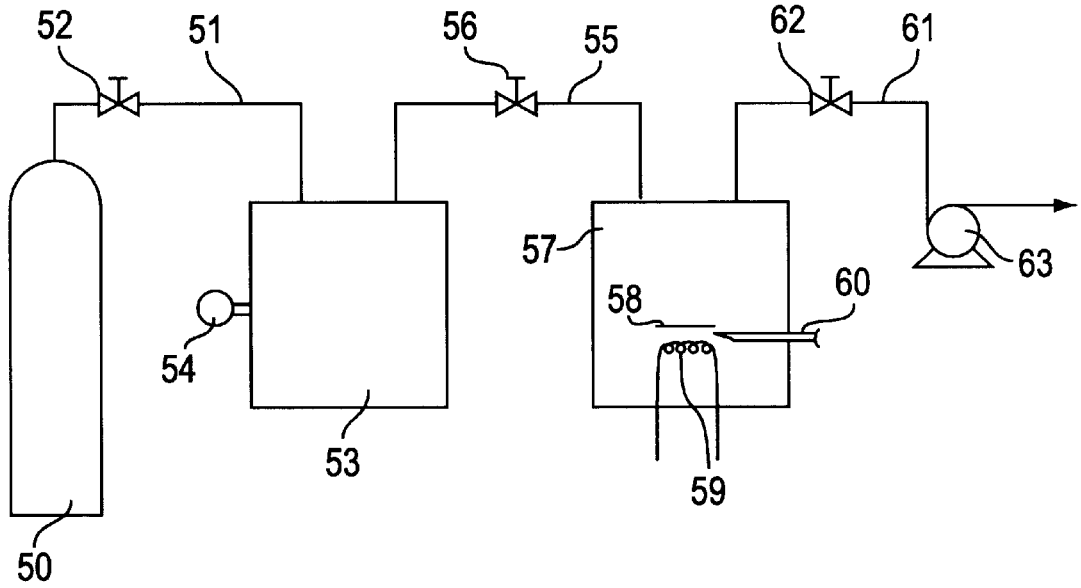
FIG. 5 is a schematic illustration of a system for charging getter materials with hydrogen.

The system employed to charge the getter material with hydrogen is illustrated schematically in FIG. 5. The charging system consisted of a main hydrogen tank 50 which tank was connected, through a first line 51 having a valve 52, to a dead space 53 provided with a pressure gauge 54. Dead space 53 was connected by a second line 55 (including a second valve 56) to a processing chamber 57. Within processing chamber 57 was arranged a sample housing 58 in which the getter material to be charged was placed. The temperature of housing 58 was controlled using a heating element 59 and measured with a thermocouple 60. Processing chamber 57 was connected through line 61 and valve 62 to a vacuum pump system 63. The design, construction and materials of this system will be familiar to those having skill in the chemical and metallurgical arts.

A 130 milligram (mg) sample of St 707 alloy, described above and available commercially from SAES Getters S.p.A. of Milan, Italy, was introduced into a ring holder and pressed to form a ring of getter material. The sample of St 707 was then introduced into the system described above for charging with hydrogen. The processing chamber was evacuated and the getter material was activated by heating to about 200° C. The material was then cooled to approximately 50° C. At this temperature hydrogen was introduced into the processing chamber at a pressure of about 0.67 mbar. The sampled was determined to have sorbed approximately 4.3 mg of hydrogen per gram of alloy using standard methods. The charged getter material is referred to herein as Sample 1.

Example 2

This Example describes the hydrogen release characteristics of a hydrogen-charged getter material under simulated frit sealing process conditions.

Figure 6:
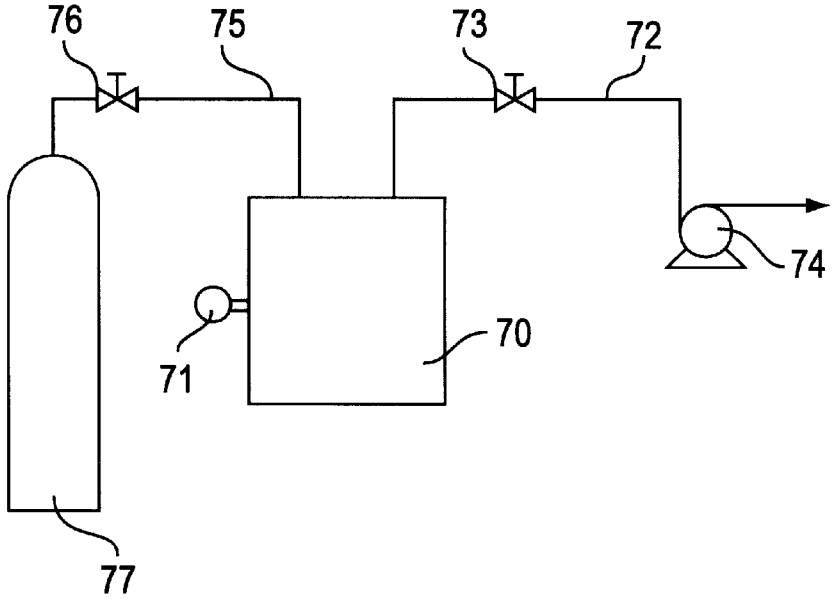
FIG. 6 is a schematic illustration of a system for measuring the quantity of gas sorbed or released by a getter materials which simulates the frit sealing process for sealing FEDs.

The hydrogen release test was performed in a vacuum system illustrated in FIG. 6. The test apparatus consisted of a chamber 70 having an attached a pressure gauge 71. The chamber was connected through a first line 72 and a first valve 73 to a vacuum pump system 74. Chamber 70 was also connected, through a second line 75 and a second valve 76, to a $CO_2$ storage tank 77 which was employed in a subsequent test. The design, construction and materials of this vacuum system will be familiar to those having skill in the chemical and metallurgical arts.

Sample 1 was introduced into chamber 70, after which the chamber was evacuated and degassed overnight (approximately 12 hours). A frit sealing simulation was then performed in which the sample was heated to 450° C. for a period of about 20 minutes, during which period valve 73 was throttled to reduce the flow of gases evacuated by the pump system 74. At the end of this period, valve 73 was closed. The remaining pressure in chamber 70 was determined to be about $1.3\times10^{-3}$ bar. The sample was then allowed to cool to the room temperature whereupon the pressure in the chamber was determined to be about $4\times10^{-6}$ mbar.

Example 3

Following the test reported in Example 2 above, a gas sorption test of the getter material was performed according to the procedures according to ASTM F 798-82. Valve 73 was closed and valve 76 was opened so as to maintain a constant $CO_2$ pressure of about $4\times10^{-5}$ mbar in chamber 70. The $CO_2$ sorption speed G ($cm^3/s$) was then recorded as a function of the sorbed quantity of $CO_2$ ($cm^3$.mbar) using standard methods. The results of the test are reported in FIG. 7 (curve "a").

Example 4 (Comparative)

The tests of Examples 2 and 3 were repeated for a sample of getter material of the same weight and size as Sample 1, but not charged with hydrogen.

Following the procedures described in Example 2 using the uncharged getter material, the pressure measured in chamber 70 was about $8\times10^{-7}$ mbar. A comparison of this result of this test with the final pressure of $4\times10^{-6}$ mbar reported in Example 2 above confirms that the final pressure measured in Example 2 is due to the release of hydrogen from the charged getter material, and that the getter material is capable of withstanding frit sealing conditions.

Figure 7:
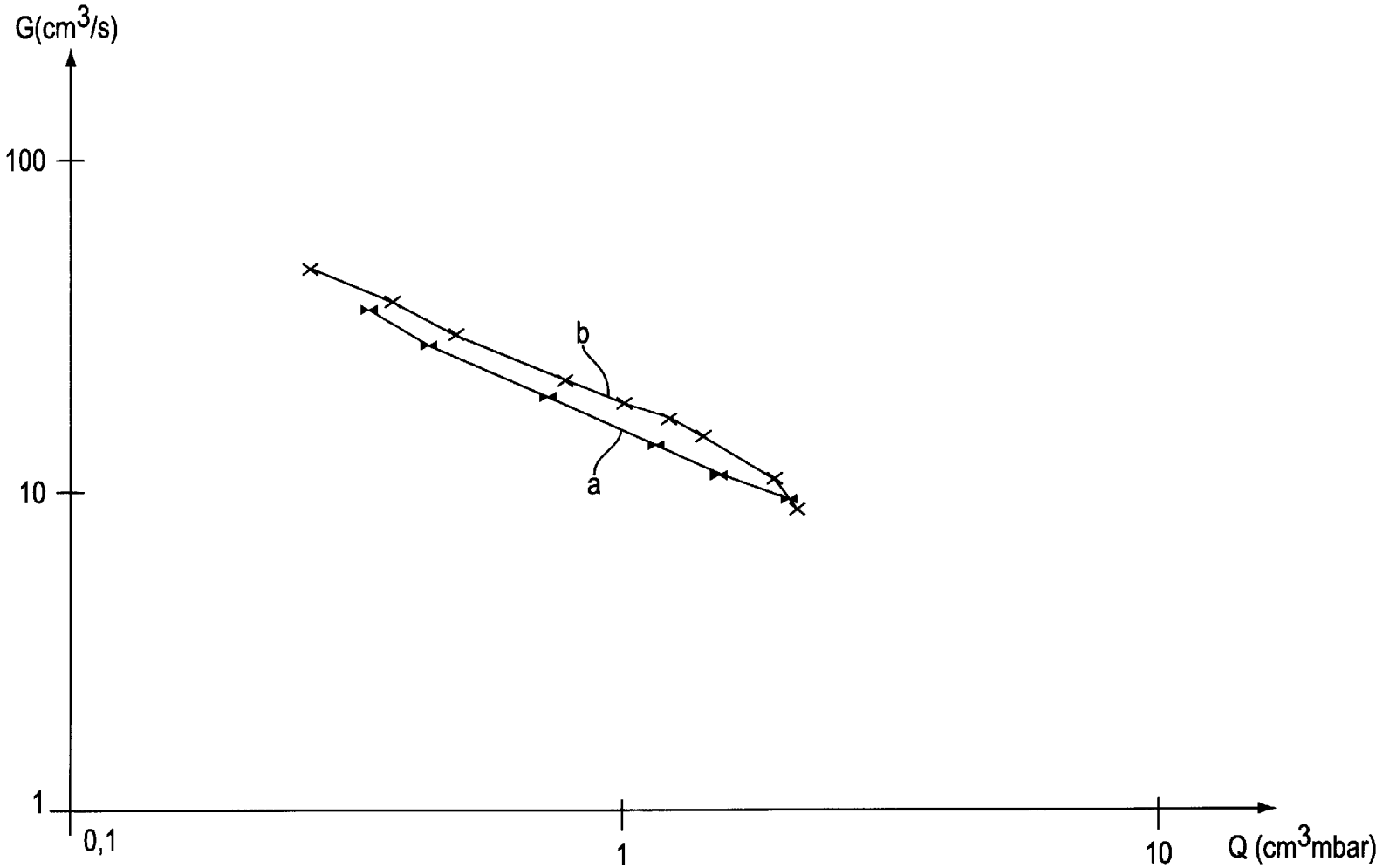
FIG. 7 shows two carbon dioxide ($CO_2$) sorbtion curves for two samples of getter material. The curve marked "a" is the $CO_2$ sorbtion curve for a first sample of getter material charged with hydrogen as described herein. The curve marked "b" is the $CO_2$ sorbtion curve for a second sample of getter material identical in composition and weight to first sample, but not charged with hydrogen.

The results of performing the test described in Example 3 using the uncharged material are reported in FIG. 7 (curve "b"). Curves "a" and "b" are seen to be substantially similar, both in magnitude and slope. Thus, the charging of the getter material with hydrogen is seen to impart no significant impairment on the ability of the charged getter material to sorb $CO_2$.

Thus, as will be appreciated from the foregoing Description and Examples, the present invention provides a method for maintaining reducing environment for a FED in addition to a FED having a self-maintaining internal reducing atmosphere. In particular, the presence of a getter material charged with hydrogen provides a pressure of hydrogen in the desired range; furthermore, the charging of the getter material with hydrogen does not interfere significantly with the action of sorbing gases other than hydrogen, thus helping to maintain a reducing environment that is relatively free of oxidizing gases during the life of the FED.

Although certain embodiments and examples have been used to describe the present invention, it will be apparent to those having skill in the art that various changes can be made to those embodiment and/or examples without departing from the scope or spirit of the present invention. For example, it will be appreciated from the foregoing that a wide variety of chargeable getter materials can be used in the present invention by analogy to the Zr—V—Fe alloy employed in the Examples. Also by way of example, the getter material can be placed in a variety of locations within the interior space of the field emitter device. The charged getter materials can also be place in a region separated from the interior space that is in fluid communication with the atmosphere of the interior space. As a further example, the charged getter materials described herein can be employed with field emitter devices fabricated using various techniques in addition to the vacuum and tail methods described herein. Additionally, the getter materials used herein can be charged with reducing gases other than hydrogen.

What is claimed:

1. A field emitter device, comprising:

a) first and second planar portions sealably joined along their perimeters, said first and second planar portions having opposing interior surfaces defining an interior space;

b) a non-evaporable getter material, localized at a discrete position in said interior space, charged with hydrogen in fluid communication with said interior space, said non-evaporable getter material being effective to release hydrogen gas into said interior space to provide thereby a substantially reducing atmosphere in said interior space; and c) a heater for regulating the temperature of said non-evaporable getter material to control thereby the amount of hydrogen released into said interior space, said heater located proximate to said non-evaporable getter and on at least one of said interior surfaces of said first and second planar portions.

2. The field emitter device of claim 1, wherein said non-evaporable getter material is an alloy having the general formula $A_{1+x}(B_{1-y}C_y)_2$, wherein a) A is Zr or Ti;

b) B and C are selected independently from the group consisting of V, Mn, Fe, Co and Ni;

c) x is between 0.0 and 0.3 inclusive; and d) y is between 0.0 and 1.0 inclusive.

3. The field emitter device of claim 2, wherein x is 0.0, y is 0.5, and said non-evaporable getter material is selected from the group consisting of TiVMn, ZrMnFe and ZrVFe.

4. The field emitter device of claim 1, wherein said non-evaporable getter material is a Zr—V—Fe alloy whose percent composition by weight, when brought into a ternary composition diagram, falls within a triangle whose vertices are the following points:

a) Zr 75%-V 20%-Fe 5%;

b) Zr 45%-V 20%-Fe 35%; and c) Zr 45%-V 50%-Fe 5%.

5. The field emitter device of claim 4 wherein said non-evaporable getter material has the composition Zr 70%-V 24.6%-Fe 5.4% by weight.

6. The field emitter device of claim 2, wherein x is 0.0.

7. The field emitter device of claim 6, wherein A is Ti.

8. The field emitter device of claim 7 wherein y is 0.5 and said non-evaporable getter material is TiVMn.

9. The field emitter device of claim 1, wherein said non-evaporable getter material is $Ti_2Ni$.

10. The field emitter device of claim 6, wherein A is Zr.

11. The field emitter device of claim 10, wherein y is 0.5 and said non-evaporable getter material is ZrVMn.

12. The field emitter device of claim 10, wherein y is 0.5 and said non-evaporable getter material is ZrVFe.

13. The field emitter device of claim 1, further comprising a tail, said tail having an interior volume that is in fluid communication with said interior space and said interior volume of said tail further being substantially isolated from the atmosphere external to said field emitter device.

14. The field emitter device of claim 13, wherein said non-evaporable getter material is arranged within said interior volume of said tail.

15. The field emitter device of claim 14, wherein said non-evaporable getter material is an alloy having the general formula $A_{1+x}(B_{1-y}C_y)_2$, wherein a) A is Zr or Ti;

b) B and C are selected independently from the group consisting of V, Mn, Fe, Co, and Ni;

c) x is between 0.0 and 0.3, inclusive; and d) y is between 0.0 and 1.0, inclusive.

16. The field emitter device of claim 15, wherein x is 0.0.

17. The field emitter device of claim 16, wherein A is Ti.

18. The field emitter device of claim 17, wherein y is 0.5 and said getter material is TiVMn.

19. The field emitter device of claim 14, wherein said non-evaporable getter material is $Ti_2Ni$.

20. The field emitter device of claim 15, wherein A is Zr.

21. The field emitter device of claim 20, wherein y is 0.5.

22. The field emitter device of claim 21, wherein said non-evaporable getter material is ZrMnFe.

23. The field emitter device of claim 21, wherein said non-evaporable getter material is ZrVFe.

24. The field emitter device of claim 13, wherein said non-evaporable getter material is a Zr—V—Fe alloy whose percent composition by weight, when brought into a ternary composition diagram, falls within a triangle whose vertices are the following points:

a) Zr 75%-V 20%-Fe 5%;

b) Zr 45%-V 20%-Fe 35%; and c) Zr 45%-V 50%-Fe 5%.

25. The field emitter device of claim 24 wherein said non-evaporable getter material has the composition Zr 70%-V 24.6%-Fe 5.4% by weight.

* * * * *